US006572222B2

(12) United States Patent
Hawkins et al.

(10) Patent No.: US 6,572,222 B2
(45) Date of Patent: Jun. 3, 2003

(54) SYNCHRONIZING PRINTED DROPLETS IN CONTINUOUS INKJET PRINTING

(75) Inventors: Gilbert A. Hawkins, Mendon, NY (US); Constantine N. Anagnostopoulos, Mendon, NY (US); David L. Jeanmaire, Brockport, NY (US); William R. Zimmerli, Fairport, NY (US)

(73) Assignee: Eastman Kodak, Company, Rochester, NY (US)

( * ) Notice: Subject to any disclaimer, the term of this patent is extended or adjusted under 35 U.S.C. 154(b) by 0 days.

(21) Appl. No.: 09/907,159

(22) Filed: Jul. 17, 2001

(65) Prior Publication Data

US 2003/0016277 A1 Jan. 23, 2003

(51) Int. Cl.[7] ..... B41J 2/09
(52) U.S. Cl. ..... 347/77; 347/82
(58) Field of Search ..... 347/21, 34, 74, 347/75, 77, 82

(56) References Cited

U.S. PATENT DOCUMENTS 3,570,275 A 3/1971 Weber et al.
3,846,800 A 11/1974 Chen
3,878,519 A * 4/1975 Eaton ..... 347/75
4,068,241 A 1/1978 Yamada
4,097,872 A * 6/1978 Giordano et al. ..... 347/21
4,190,844 A * 2/1980 Taylor ..... 347/82
6,220,693 B1 * 4/2001 Bode et al. ..... 347/34
6,364,470 B1 * 4/2002 Cabal et al. ..... 347/82

FOREIGN PATENT DOCUMENTS

EP 0911168 4/1999

* cited by examiner

*Primary Examiner*—Anh T. N. Vo
(74) *Attorney, Agent, or Firm*—William R. Zimmerli

(57) ABSTRACT

Both an inkjet printer and method are provided for controlling inkjet printing on a receiver. The inkjet printer includes a printhead having at least one nozzle for ejecting a stream of ink droplets, a droplet deflector for generating a flow of gas that impinges on the stream of ejected droplets to deflect the trajectories of the droplets, and a controller for varying the velocity of the gas flow in order to vary the degree of trajectory deflection so the droplets intended to print on a particular pixel in the receiver land on top of one another without elongation despite relative movement between the printhead and the receiver. The printer provides improved image quality and productivity while reducing image artifacts.

35 Claims, 16 Drawing Sheets

SYNCHRONIZING PRINTED DROPLETS IN CONTINUOUS INKJET PRINTING

CROSS REFERENCE TO RELATED APPLICATIONS

Reference is made to U.S. application Ser. No. 09/750,946, entitled Printhead Having Gas Flow Ink Droplet Separation And Method Of Diverging Ink Droplets, filed in the name of Jeanmaire and Chwalek on Dec. 28, 2000; U.S. application Ser. No. 09/751,232, entitled A Continuous Ink-Jet Printing Method And Apparatus, filed in the names of Jeanmaire and Chwalek on Dec. 28, 2000; U.S. application Ser. No. 09/751,563, entitled Ink Jet Apparatus Having Amplified Asymmetric Heating Drop Deflection, filed in the names of Chwalek, Delametter and Jeanmaire on Dec. 28, 2000; and U.S. application Ser. No. 09/777,426, entitled Continuous Inkjet Printhead and Method of Translating Ink Drops, filed in the names of Hawkins and Jeanmaire on Feb. 6, 2001.

FIELD OF THE INVENTION

This invention generally relates to inkjet printing, and is specifically concerned with an apparatus and method for continuously displacing the trajectories of droplets ejected from an inkjet printhead toward a relatively moving receiver so that droplets intended for a particular location on the receiver land on top of one another.

BACKGROUND OF THE INVENTION

There are two types of inkjet printers, including drop-on-demand printers in which the printhead nozzles eject droplets only when it is desired to print ink onto a receiver, and continuous inkjet printers in which the printhead nozzles eject droplets continuously, the droplets not desired to be printed being captured by a gutter. Both methods are currently practiced.

In drop-on-demand printers, the printhead 1 typically includes a linear row of nozzles 3 which is scanned across a stationary receiver 5 in a fast scan direction 7 as shown in PRIOR ART FIG. 1*a*. Commercially available desktop printers, for example those made by Epson, operate in this manner. After each fast scan the printhead moves in a slow scan direction 9 relative to the receiver, the slow scan direction being orthogonal to the fast scan direction. Typically, the receiver is moved in the slow scan direction 9 rather than the printhead to effect the relative movement, and another row of printing is completed as is indicated in phantom.

In continuous inkjet printers, the receiver is often moved in the fast scan direction rather than the printhead due to the size and complexity of the printhead. In many cases, the printhead is pagewide and extends across the entire width of the paper to obviate the need for a second scanning movement. The fast scan motion of the printhead relative to the receiver is typically parallel to the length of the printhead.

Drop-on-demand and continuous inkjet printers print droplets on a regularly spaced grid of printing locations or pixels on a receiver, typically at a density of from a few hundred to more than two thousand pixels per inch. Both types of inkjet printers may operate in either a binary (black and white) mode of printing or a contone (also referred to as grayscale) mode of printing. In the binary mode, either a single droplet of a fixed size is printed at each pixel or no droplet is printed. In the contone mode of printing, the amount of ink printed onto a given pixel can be varied over a range of sizes or levels, for example, 10 or more levels. One method to vary the amount of ink printed at each pixel is in contone printing to eject droplets of differing size. However, such an approach is well known in the art to be difficult if substantial variations in droplet size are required, which is usually the case in contone printing. Another method is to print more than one droplet of a fixed size at a given pixel at different times. For example, a second droplet may be printed on a subsequent fast scan pass. This method greatly slows the printing process, especially if substantial variations in the amount of ink per pixel are required. A third more widely practiced method is to eject all of the droplets required at a given pixel during a single scan pass print in rapid sequence so that the droplets print at substantially the same time. In some cases this has been achieved by arranging for each group of sequentially ejected droplets to combine together before landing on the receiver. However, droplets which combine before landing on the receiver may not land at exactly the desired position, since they have been ejected over a range of times. Also the combined droplet may not be spherical when it lands, resulting in image artifacts. In other printers, a group of droplets is sequentially ejected so that the droplets land on the same pixel on the receiver. However, if the receiver is moving quickly relative to the printhead (as desired to achieve high productivity) the droplets landing in a group may be printed as an elongated group that is smeared on the pixel in the direction of receiver motion. Such an elongation within the printed pixel also produces image artifacts and lowers image quality.

To overcome these problems, U.S. Pat. No. 6,089,692, issued to Anagnostopoulos on Aug. 8, 1997, discloses a contone printing method wherein the motion of the receiver is modulated with respect to the printhead by rapidly starting and stopping the receiver in the fast scan direction. This method advantageously allows sequential droplets ejected in a group to be printed at an identical location, thus avoiding pixel smearing. Preferably, the printhead ejects a sequence of equally sized droplets that do not combine before landing on the receiver. During printing of a group of droplets, the receiver motion with respect to the printhead is effectively stopped, and the receiver is moved before the next droplet or group of droplets is printed. Unfortunately, this method requires expensive and precise mechanical controls and hence adds to the cost of the printer and additionally may reduce printer speed due to the time required to accelerate and decelerate heavy components. It is, of course, possible to accelerate the printhead relative to the receiver. But if this is attempted, the printhead may perform poorly due to fluid acceleration and consequent pressure differentials in the ink along the length of the printhead. This is particularly true for pagewide printheads because of the long fluid channels that are distributed over the entire length of the printhead, especially if the displacement occurs rapidly.

Clearly, there is a need for an improved method for contone printing in which a printhead ejects groups of identically sized droplets that land at a single location on the receiver in order to achieve high image quality at no expense to productivity. It would be desirable if such a method could be achieved without the need for expensive and precise mechanical controls that modulate relative movement between the printhead and receiver. Ideally, such a method should be applicable to both drop-on-demand and continuous stream printers. In the case of continuous stream printers, such a method should be achieved without the need for adding any new and expensive droplet steering mechanisms to the printer.

SUMMARY OF THE INVENTION

The present invention includes both an apparatus and method for contone inkjet printing using printheads which eject groups of identically sized ink droplets intended to be printed together at a single printing location or pixel. In accordance with the present invention, droplets in such a group land at a single location on the receiver despite the fact that the receiver moves uniformly with respect to the printhead. The trajectories of droplets ejected sequentially in the group are continuously altered so that droplets ejected later in time travel further in the direction of motion of the receiver than do droplets ejected earlier in time. Such trajectory alteration is accomplished by means of the same droplet deflector that is used to separate printing from non-printing droplets. The droplet deflector generates a flow of gas that impinges on the droplet stream comprised of larger and smaller droplets to deflect the larger droplets away from a gutter that captures and recycles the smaller droplets. A controller varies the speed of the deflecting gas flow to further deflect the trajectories of the larger droplets intended for printing so that the droplets intended for a particular pixel land on top of one another despite continuous relative movement between the printhead and the receiver. The apparatus and method are useful in reducing image artifacts and improving image quality and productivity.

While the preferred application of the invention is in a continuous stream inkjet printer, the invention may also be used in a drop-on-demand type inkjet printer.

The droplet deflector includes a tube having an outlet for directing a gas flow into trajectory-altering impingement with the droplets. In one embodiment of the invention, the controller includes a gas flow restrictor for varying the gas flow velocity exiting the tube outlet by variably restricting the gas flow through the tube. The gas flow restrictor may take the form of an expandable bladder disposed within the tube interior. Alternatively, the gas flow restrictor may include a plurality of movable cantilevers, which are either electrostatically or thermally controlled via bimetallic elements that are mounted around the inner surface of the tube. In still another embodiment, the gas flow restrictor may include a plurality of movable vanes disposed within the tube, which restrict more or less of the gas flow in the same manner as venetian blinds.

In still other embodiments of the invention, the controller may include a pressure pulse generator for varying the gas flow velocity in the deflector tube. The pressure pulse generator may include a speaker-like diaphragm in communication with the tube that is connected to an armature which rapidly moved by a piezoelectric transducer. In still another embodiment, the pressure pulse generator may include a diffuser disposed within the tube in combination with a vibrational mechanism that variably vibrates the tube and diffuser toward and away from the droplet stream to create pressure waves within the tube.

In still another group of embodiments, the controller may include an oscillating mechanism for variably oscillating the outlet of the tube with respect to the droplet stream. The direction of the oscillations may be perpendicular to a longitudinal axis of the tube. Alternatively, the oscillations may be in a pivotal direction around a point on the longitudinal axis of the tube.

In all cases, the controller varies the degree of trajectory deflection for the droplets in the stream such that droplets intended for printing on a selected pixel on the receiver are deposited substantially on top of one another despite relative movement between the printhead and the receiver.

BRIEF DESCRIPTION OF THE DRAWINGS

FIG. 7*a* illustrates the average airflow velocities experienced by each drop.

DETAILED DESCRIPTION OF THE INVENTION

Figure 1A:
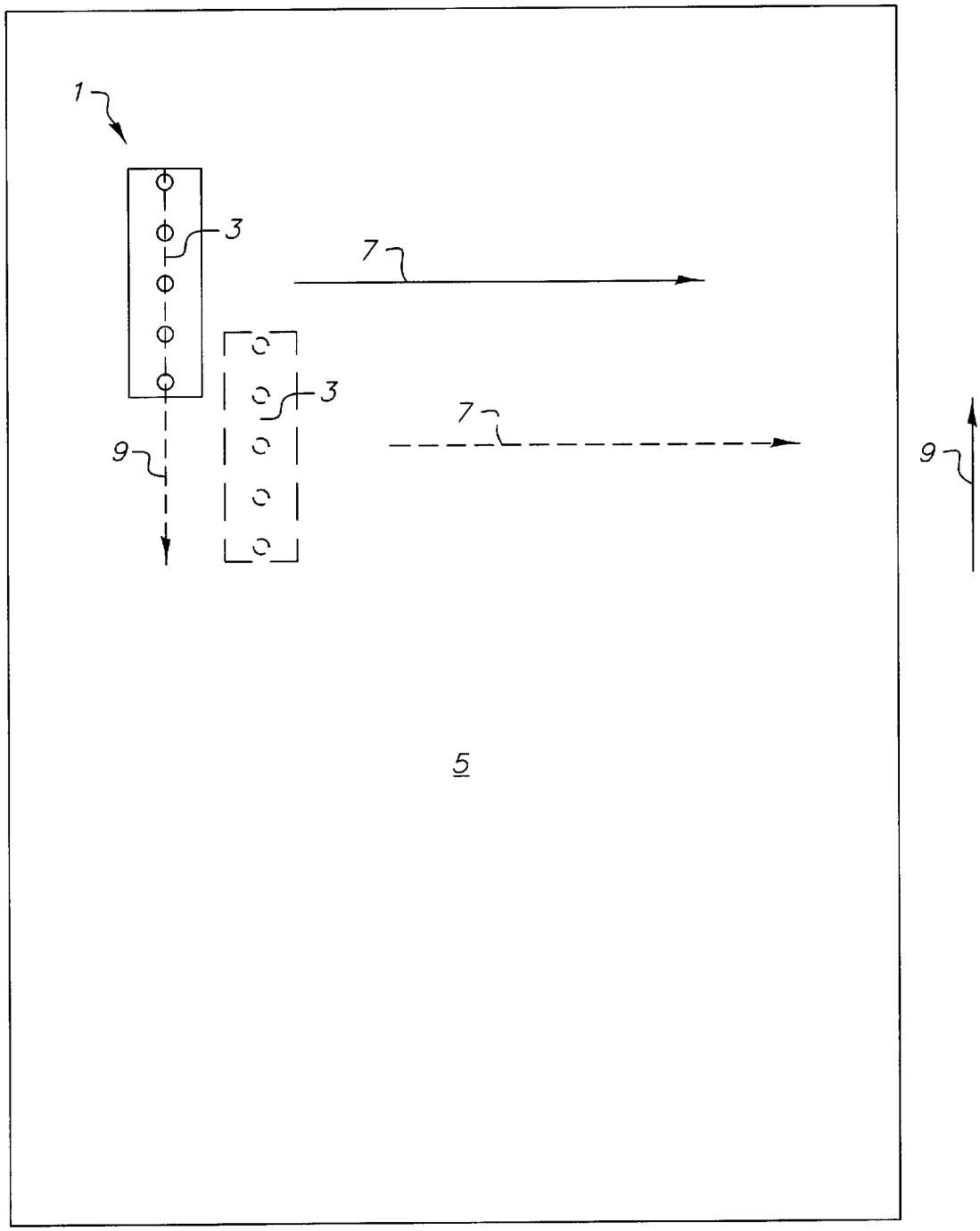
FIG. 1a PRIOR ART
FIG. 1*a* shows a prior art method of printing with mechanical translation of an inkjet printhead scanned over a receiver.
Figure 1B:
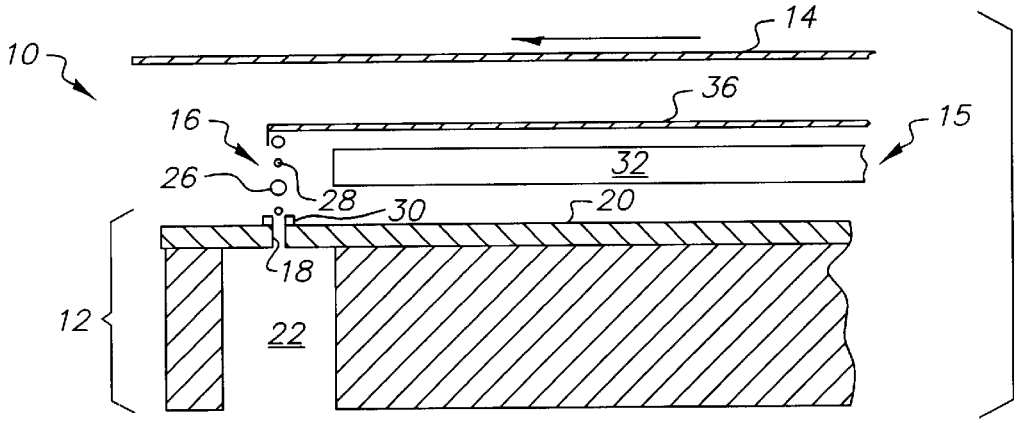
FIGS. 1*b* and 1*c* show partial cross-sectional view of an inkjet printer in accordance with the present invention having a droplet deflector that employs a flow of air from an air tube located above a row of nozzles to deflect ink droplets.
Figure 1C:
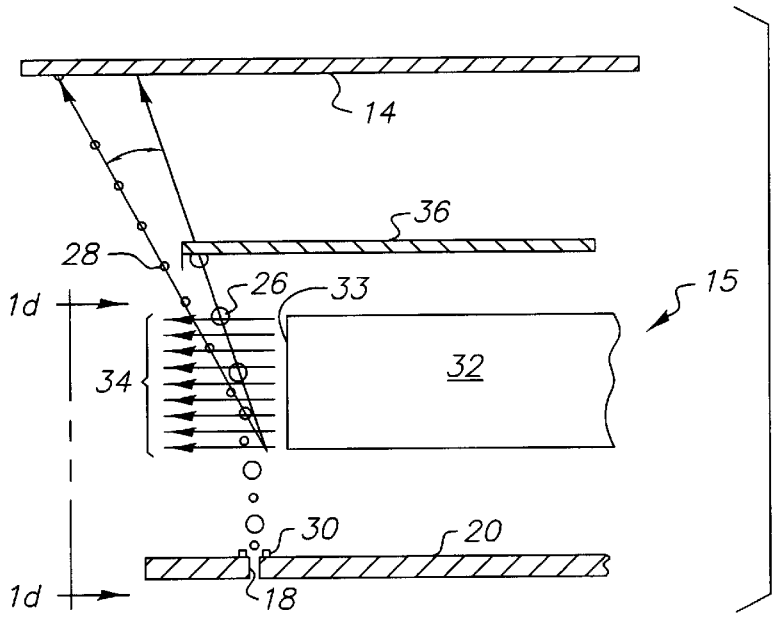
Figure 1D:
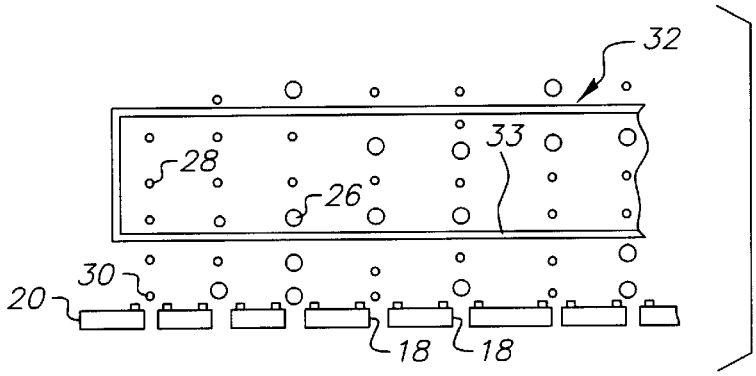
FIG. 1*d* is a side view of the air tube and printhead nozzles of FIGS. 1*b* and 1*c* along the line 1*d*—1*d*.

FIGS. 1*b* and 1*c* schematically illustrate a continuous stream inkjet printer 10 in accordance with the present invention, the printer 10 having a printhead 12, a receiver 14, and a droplet deflector 15 that utilizes an airflow to deflect differently sized ink droplets. Ink droplets 16 are ejected from a nozzle 18, the nozzle 18 typically having been formed in a membrane 20 overlying an ink cavity 22. The ejected droplets 16 are selected to have at least one of two sizes, a large size 26 and a small size 28. Such selective sizing of the ink droplets may be accomplished by means of small annular heating elements 30 that circumscribe each of the nozzles 18. Electrical power is conducted in pulses to each of the heating elements 30 as droplets are ejected therefrom. Depending upon the frequency of the pulses, the surface tension of the ink is affected such that small droplets 26 are generated during higher frequencies, while larger droplets 28 are generated during lower frequencies. An airstream 34 flows across the trajectory followed by the ejected droplets 16, and a gutter 36 is provided to capture the large size droplets 26 that impinge on the end of the gutter 14. The airstream 34 is shown in FIG. 1*c*, extending from the open end of the air tube 32. Printed droplets, which are of the small size 28, experience a greater deflection angle when passing through the airstream 34 than do guttered droplets, which are of the large size 26. As is shown in FIG. 1*d*, the opening 33 of the air tube 32 is somewhat elongated in shape and positioned over and to the side of the nozzles 18 of the printhead 12, each of which is ejecting a combination of small and large droplets in accordance with the frequency of pulses received by their respective heating elements 30. In the subsequent discussions, only the trajectory of the printed droplets is considered.

Figure 2A:
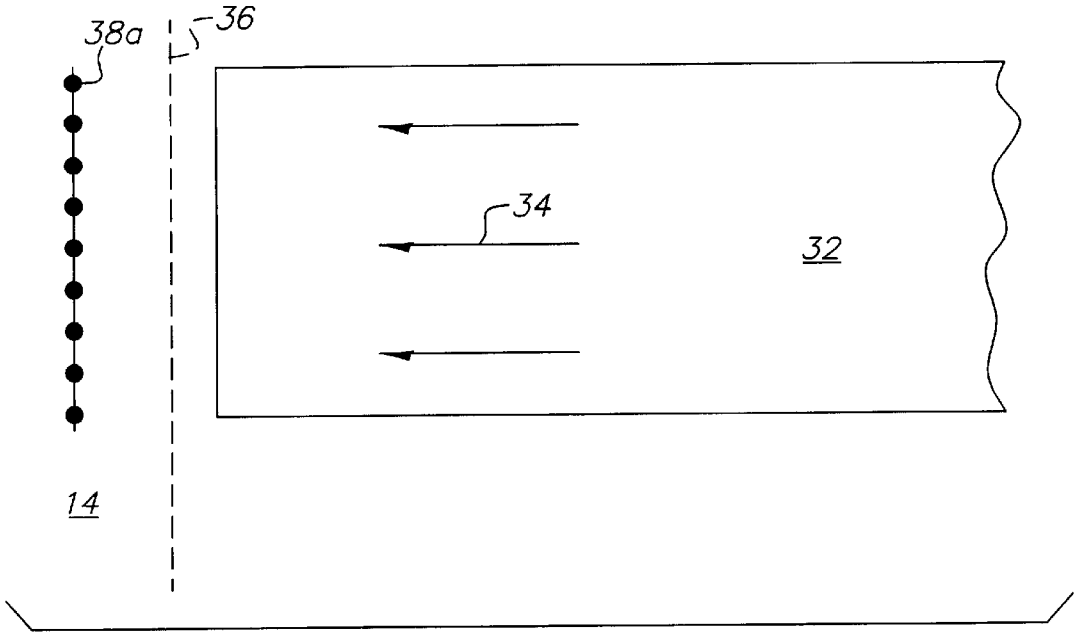
FIGS. 2*a*–2*b* are top views of the air tube of FIGS. 1*b* and 1*c* located above a row of nozzles in a continuous inkjet printhead wherein the airstream flows at different velocities to deflect ejected droplets a greater or lesser amount of flow of an airstream through the air tube.
Figure 2B:
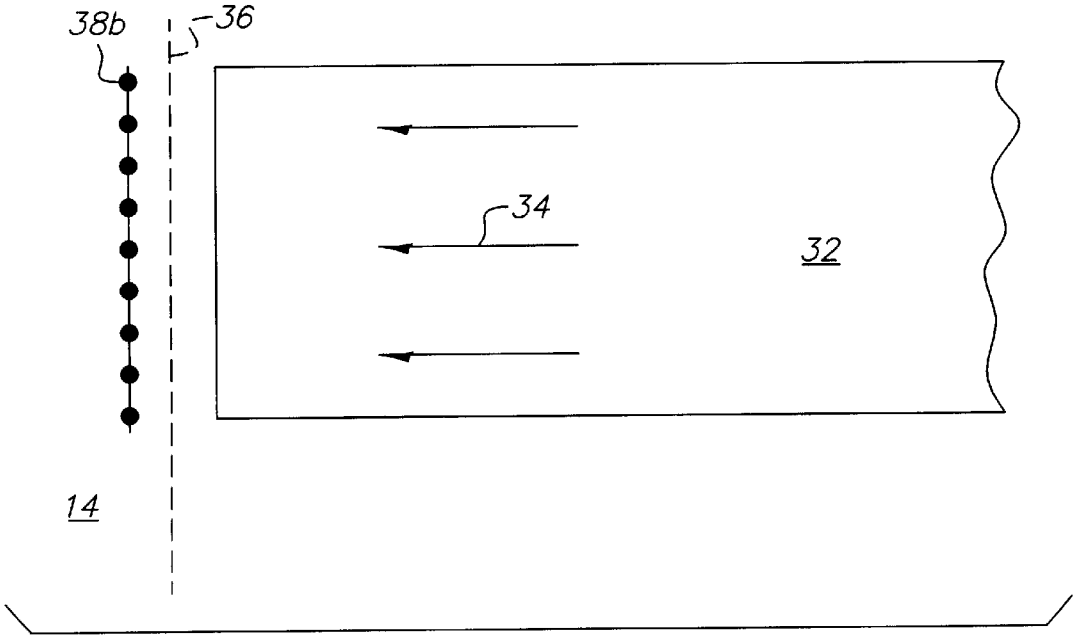

In order to illustrate the principal of operation of the invention and its embodiments, FIGS. 2*a* and 2*b* show top views of the air tube 32 of the inkjet printer 10 and the droplets printed on a receiver which results from simultaneously ejecting small droplets from each nozzle. The location of the edge of the gutter is shown as a phantom line in FIGS. 2*a*–6. The phantom line is a useful reference point in indicating the displacement of the printed droplets 38 in the fast scan direction due to passage though the airstream 34. The velocity of airflow 34 in the air tube 32 is about the same as the airstream velocity outside the tube and near its outlet 33.

The airflow in the air tube 32 in FIG. 2*a* is shown as having a higher airflow velocity, in comparison with the velocity shown in FIG. 2*b*, where the airflow is shown as having a lower airflow velocity. As shown by the difference in the distance of the printed droplets from the gutter location, the lower airflow velocity reduces the displacement experienced by the droplets while traversing the airstream; in other words, the deflection angle in FIG. 1*c* has been reduced. As will be described later, although the change in displacement of the printed droplets 38 in FIGS. 2*a* and 2*b* has been described as a case in which airflow 34 in the air tube 32 and hence the airflow velocity is constant in time, the same result holds on average if the airflow velocity is changing at any point of the droplet trajectory in the airflow. The displacement of droplets is approximately proportional the average airflow velocity experienced by the droplet during passage through the airflow 34. It should be noted that while reference is frequently made herein to a change in airflow velocity, such velocity changes are made over a baseline velocity which is the minimum necessary for the airflow 34 to deflect the small droplets 20 beyond the capturing edge of the gutter 36.

Figure 2C:
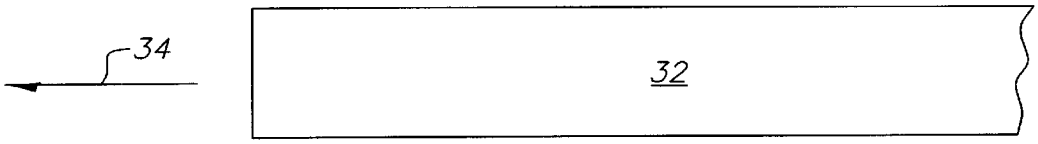
FIGS. 2*c*, 2*d*, and 2*e* depict side views of the air tube in FIGS. 2*a* and 2*b*, and the effect the different airstream velocities have on the printed droplet.
Figure 2D:
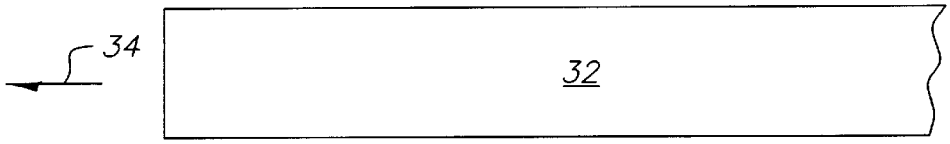
Figure 2E:
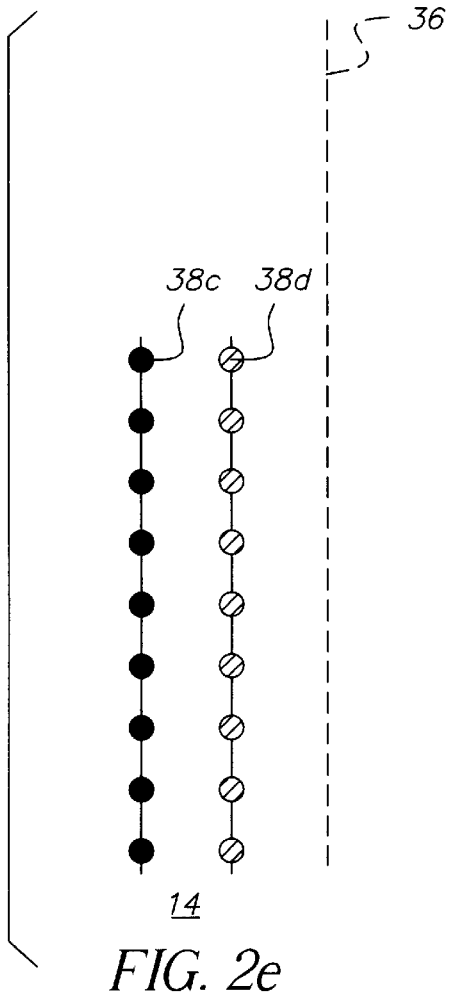

FIGS. 2*c*–2*d* show a cross-section of the air tubes and airstreams 34 of FIGS. 2*a* and 2*b*, respectively. The airstream 34 extends near the end of the air tubes 32 vertically from the bottom to top of the air tubes. FIG. 2*e* is a schematic representation of the displacements of printed droplets 38*c, d* with respect to the gutter position (dotted line) corresponding to the airstream velocities of FIGS. 2*c* and 2*d*, respectively. The format of FIGS. 2*c*–2*d* is used subsequently in describing preferred embodiments of the apparatus of the present invention.

Figure 3A:
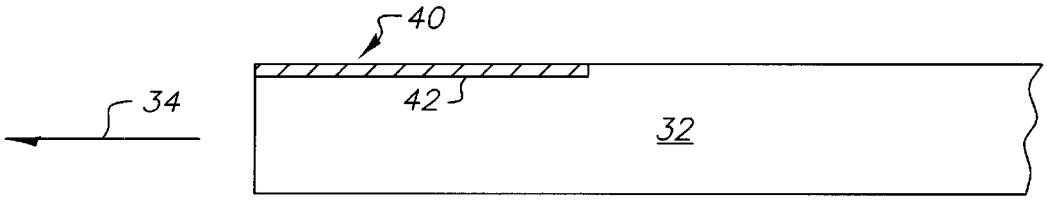
FIGS. 3*a* and 3*b* show a side cross-sectional view of an air tube having an airflow restricter at the end of the air tube in a contracted (FIG. 3*a*) and an extended (FIG. 3*b*) position.
Figure 3B:
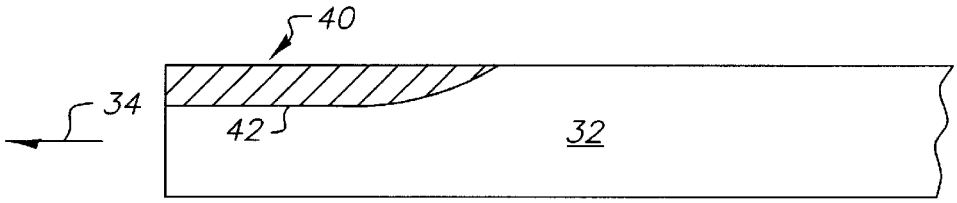
Figure 3C:
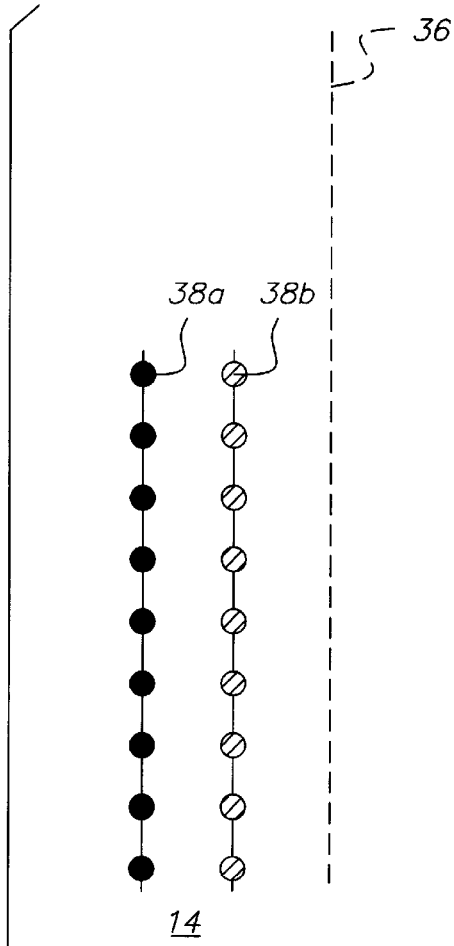
FIG. 3*c* shows a top view of the location of droplets printed on a receiver from a fast and a slow airstream corresponding to the contracted and expanded restricter of FIGS. 3*a* and 3*b* respectively.

FIGS. 3*a*–3*c* show a cross-section of an air tube 32 having an airflow restrictor 40 at the open end of the air tube 32. The airflow restrictor 40 comprises a moveable solid or solid surface which can be extended into the air tube 32 to partially block airflow 34 in the tube 32. For example, an airflow restricter 40 may be an expandable elastic membrane 42 which can be extended into the air tube by inflating the cavity between the membrane 42 and the top of the inner wall of the air tube 32. FIG. 3*b* shows the airflow restricter in the contracted state, in which case the airflow velocity is high. FIGS. 3*c* shows the airflow restricter in the extended state, in which case the airflow velocity is lowered. FIG. 3*c* is a schematic representation of the displacements of printed droplets 38*a, b* with respect to the gutter position (dotted line) corresponding to the airstream velocities of FIGS. 3*a* and 3*b*, respectively. The format of FIGS. 2*c*–2*d* has been used in FIGS. 3*a*–3*c* in describing these preferred embodiments of the apparatus employed to alter the displacement of printed droplets.

Figure 3D:
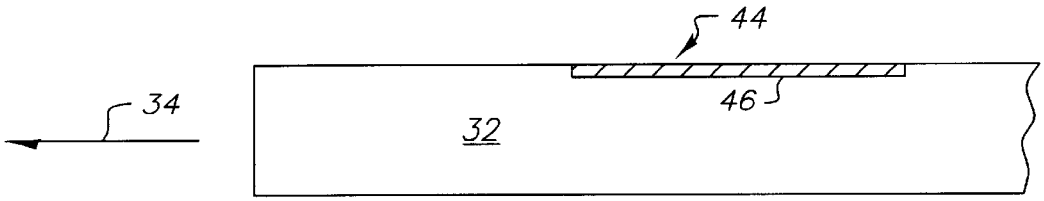
FIGS. 3*d* and 3*e* show a side cross-sectional view of an air tube having an airflow restricter centrally located in the air tube in a contracted (FIG. 3*d*) and an extended (FIG. 3*e*) position.
Figure 3E:
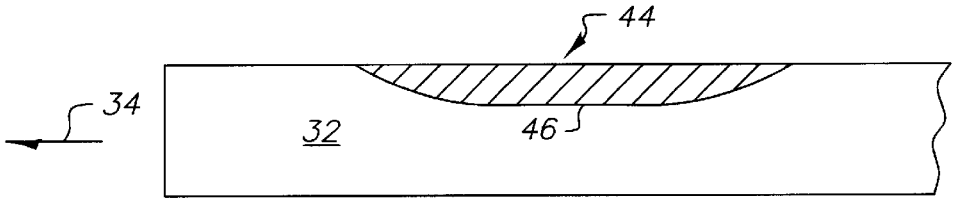

FIGS. 3*d*–3*e* show a cross-section of an air tube 32 having an airflow restrictor 44 centrally located in the air tube 32. A central location is advantageous in that the effects of small geometrical imperfections in the airflow restricter 44 are averaged out to an appreciable extent by the time the flowing air reaches the open end of the air tube 32. Again, an airflow restricter comprises a moveable solid or solid surface 46, which can be extended into the air tube 32 to partially block airflow 34 in the air tube 32, as in the previous embodiment.

Figure 3F:
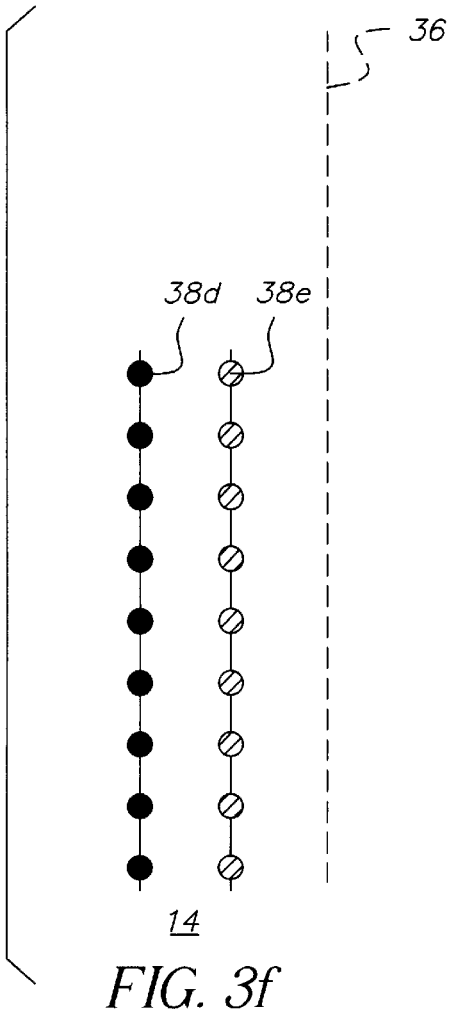
FIG. 3*f* shows a top view of the location of droplets printed on a receiver from a fast and a slow airstream corresponding to the contracted and expanded restricter of FIGS. 3*d* and 3*e*, respectively.

FIG. 3*d* shows the airflow restrictor 44 in the contracted state, in which case the airflow velocity is high. FIG. 3*e* shows the airflow restricter in the extended state, in which case the airflow velocity is lowered. FIG. 3*f* is a schematic representation of the displacements of printed droplets 38*d, e* with respect to the gutter position (dotted line) corresponding to the airstream velocities of FIG. 3*d* and 3*e*, respectively. Again, the format of FIGS. 2*c*–2*d* has been used in FIGS. 3*d*–3*f* in describing this embodiment of the apparatus.

Figure 3G:
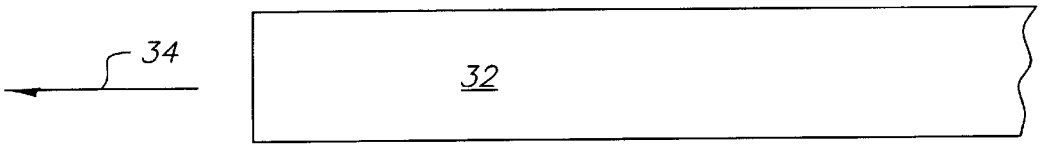
FIGS. 3*g* and 3*h* show a side cross-sectional view of an air tube having a rectangular and tapered channel, respectively, at the end of the air tube.
Figure 3H:
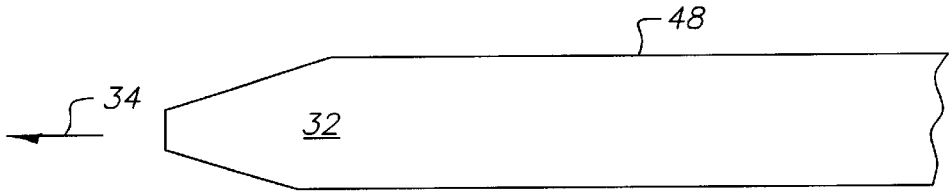
Figure 3I:
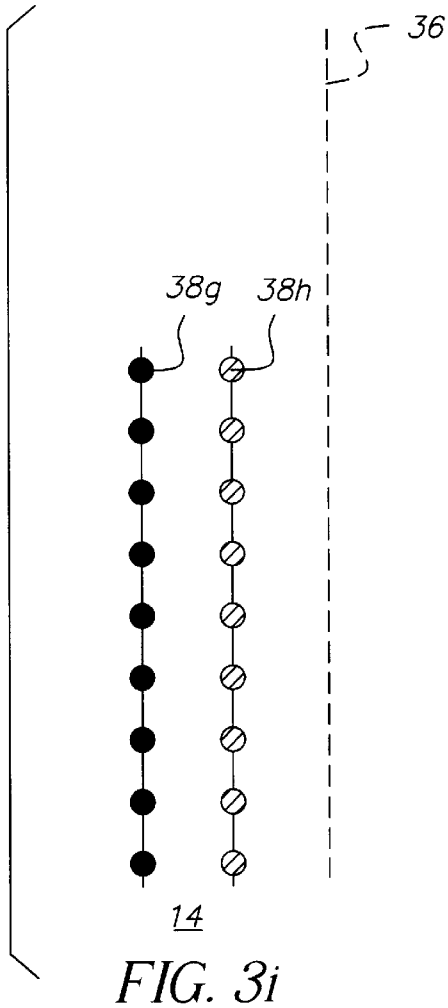
FIG. 3*i* shows a top view of the location of droplets printed on a receiver from a fast and a slow airstream corresponding to the rectangular and tapered channels of FIGS. 3*g* and 3*h*, respectively.

FIGS. 3*g*–3*h* show a cross-section of an air tube 32 having a tapered end portion 48 at the end of the air tube. A central location of such a tapered portion 48 in the air tube 32 could also be used advantageously for the same reasons cited in the previous embodiment. The tapered portion 48 could be provided by mechanical alteration of the top and bottom portions of the air tube 32, for example by hinging the top and bottom sections. FIG. 3*g* shows the air tube 32 having a rectangular cross-section, in which case the airflow velocity is high. FIG. 3*h* shows the air tube 32 having a tapered end portion 48, in which case the airflow velocity is lowered. FIG. 3*i* is a schematic representation of the displacements of printed droplets 38*g, h* with respect to the gutter position (dotted line) corresponding to the airstream velocities of FIG. 3*g* and 3*h*, respectively. Again, the format of FIGS. 2*c*–2*d* has been used in FIGS. 3*g*–31 in describing this embodiment.

Figure 4A:
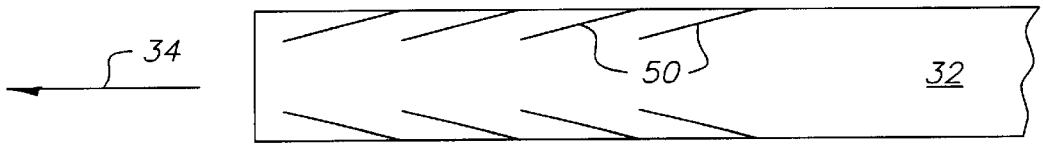
FIGS. 4*a* and 4*b* show a side cross-sectional view of an air tube having a contracted and expanded upper and lower control surface, respectively.
Figure 4B:
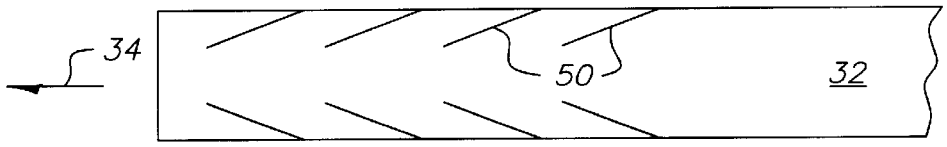
Figure 4C:
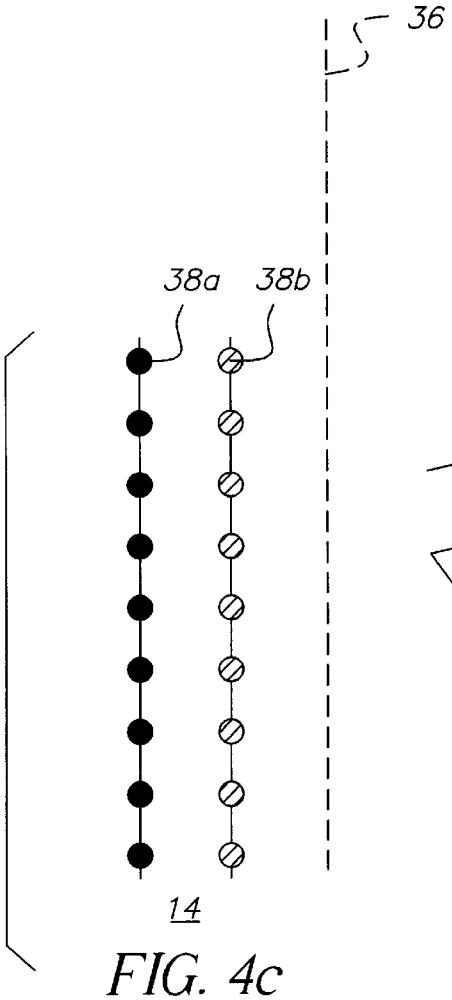
FIG. 4*c* shows a top view of the location of droplets printed on a receiver from a fast and a slow airstream corresponding to the contracted and extended upper and lower control surfaces of FIGS. 4*a* and 4*b*, respectively.
Figure 4D:
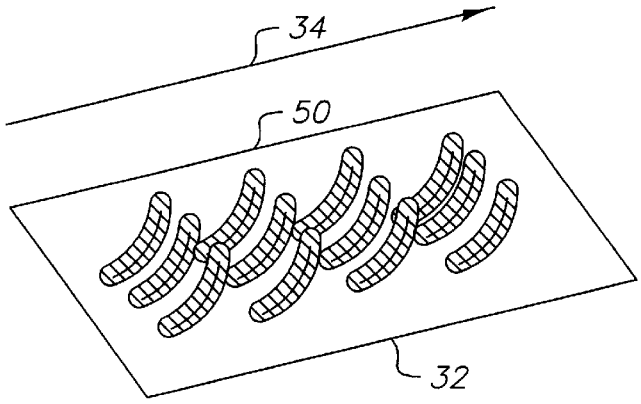
FIG. 4*d* shows a three dimensional view of a control surface having cantilevers in a state corresponding to an extended control surface.

FIGS. 4*a*–4*b* are a cross-sectional view of an air tube 32 having an airflow control surface centrally located in the air tube 32. An airflow control surface is known to the art of microstructure fabrication as a solid surface having moveable cantilevers 50 which may be extended upwards to partially redirect airflow. Typically, the cantilevers 50 are conductive and are fabricated in an extended state. Their motion is controlled by application of a voltage to the cantilevers 50 by control means (not shown) which results in their motion due to electrostatic attraction. Typical cantilever dimensions are in the range of 1 to 100 microns in width and 10–1000 microns in length. Also known to the art of control surfaces are bimetallic actuators, in which the cantilevers 50 are formed by stacking two materials (insulated one from another if both are metallic) having different thermal expansion coefficients and passing a current through one to heat the structure thereby causing a curling motion. FIG. 4*a* shows the cantilevers 50 in a contracted state, in which case the airflow velocity is high. FIG. 4*b* shows the cantilevers 50 in an extended state, in which case the airflow velocity is lowered. FIG. 4*c* is a schematic representation of the displacements of printed droplets 38*a, b* with respect to the gutter position (dotted line) corresponding to the airstream velocities of FIG. 3*j* and 3*k*, respectively. Again, the format of FIGS. 2*c*–2*d* has been used in FIGS. 4*a*–4*b* in describing this embodiment. The cantilevers 50 are shown in FIG. 4*d* as rectangular, but their shape is not required to be rectangular so long as the individual cantilevers 50 can be controlled.

Figure 4E:
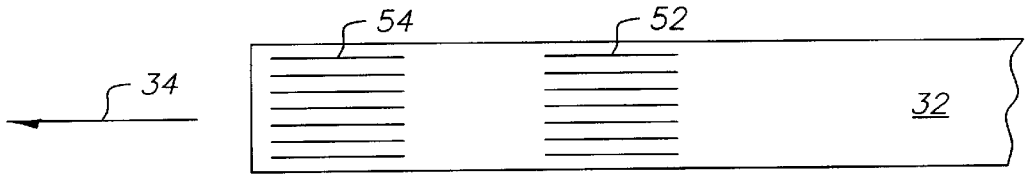
FIG. 4*e* shows a top view of an airstream including a first and second set of guide vanes for altering the direction of the airstream, both guides being horizontal.
Figure 4F:
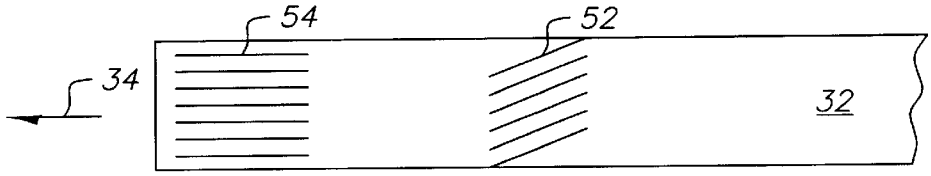
FIG. 4*f* shows a side cross-sectional view of an air tube of an airstream deflector having a first and second set of guide vanes for controlling airflow, the second guide vanes being angled.
Figure 4G:
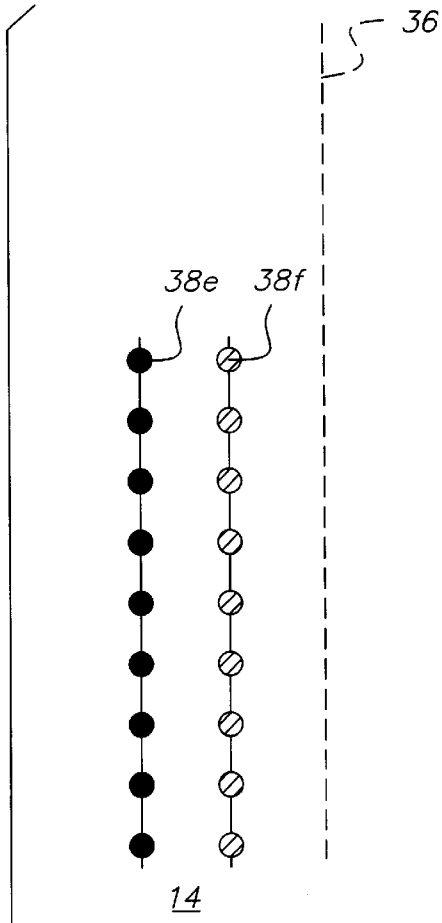
FIG. 4*g* shows a top view of the location of droplets printed on a receiver corresponding to the horizontal and angled second guide vanes of FIGS. 4*e* and 4*f*, respectively.

FIGS. 4*e*–4*f* represent a side cross-section of an air tube 32 having two sets of airflow control vanes 52, 54 located in the air tube 30, one near the air tube end (fixed airflow control vane) and the other centrally located (adjustable airflow control vanes 54). Such an airflow control vane can be constructed from a freestanding thin film, which may be tilted away from the direction of airflow 34 in a manner similar to a venetian blind. FIG. 43 shows both sets of vanes 52, 54 oriented parallel to the airflow, in which case the airflow 34 velocity is high. FIG. 4*f* shows the central airflow control vanes 52 to be angled, so that the airpath is now perturbed. FIG. 4*g* is a schematic representation of the displacements of printed droplets 38*e, f*, with respect to the gutter position (dotted line) corresponding to the airstream velocities of FIGS. 4*e* and 4*f*, respectively. Again, the format of FIGS. 2*c*–2*d* has been used in FIGS. 4*e*–4*f* in describing this embodiment. The perturbed airflow 34 reduces the airstream velocity and hence reduces the distance by which the printed droplets 38*e, f* are swept while traversing the airstream.

Figure 4H:
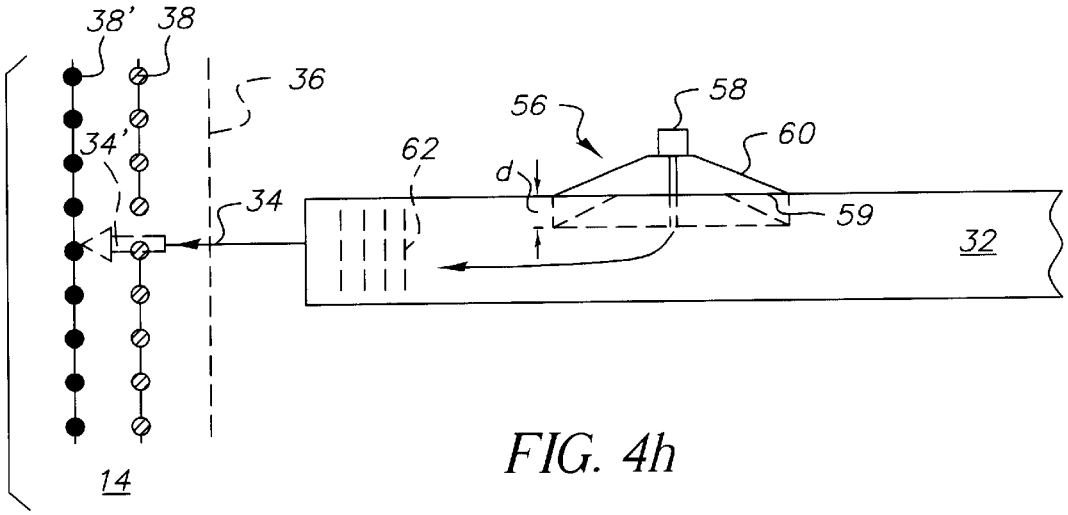
FIG. 4*h* shows a side cross-sectional view of an air tube of an airstream deflector having a transducer and plate located centrally.

In yet another preferred embodiment, shown in FIG. 4*h*, the air tube contains a pressure pulse generator 56, for example a piezo transducer 58, capable of changing its vertical dimension in the presence of an applied electric voltage. The piezo transducer 58 is mounted on the top of the air tube 32, with a diaphragm 59 attached to the bottom of the transducer 58 via an armature 60 so that vertical motion "d" of the diaphragm displaces a significant mass of air and creates a compressive wave 62. Preferably, the diaphragm 59 of the transducer 58 extends entirely across the air tube 32 as viewed from the top, and preferably the maximum extent of motion "d" of the diaphragm 59 of the transducer 58 is several percent of the height of the air tube 32, that is from 10 to 1000 microns. As is well know in acoustic technology, when a voltage is applied to the piezo transducer 58, armature 60 moves the diaphragm 59 downward in response, creating a pressure pulse in the flow of air through the air tube 32. This results in a forward pressure wave 62 which travels rapidly to the end of the tube 32. This pressure wave 62 is used in accordance with the present invention to modulate the airstream velocity and thereby the droplet trajectories. For example, an oscillatory motion of the diaphragm at moderate acoustic frequencies, such as frequencies of from 1 to 50 kHz, will result in periodic pressure waves in the tube 32 and hence in periodic changes in the velocity of the airstream 34, 34' (shown in phantom) and thus in the trajectory of droplets. Although not shown in FIG. 4*h*, it is advantageous to minimize the airspace above the diaphragm by filling this region with a closed cell elastic foam extending to the top side of the air tube 32, so that motion of the diaphragm does not cause airflow perturbations above the plate. Changes in the locations of printed droplets 38, 38' resulting from such a pressure pulse generator 56 in the air tube 32 are shown with respect to the gutter position in FIG. 4*a*.

Figure 4I:
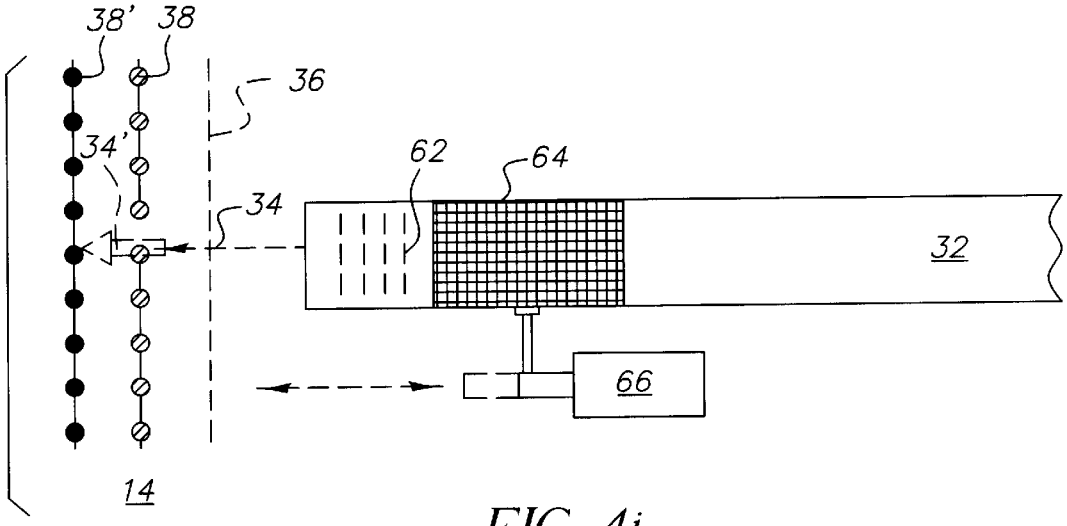
FIG. 4*i* shows a side cross-sectional view of an air tube of an airstream deflector having a diffuser located centrally. The air tube and diffuser are mechanically displaced periodically in the direction of diffuser motion.

FIG. 4*i* shows yet another embodiment employing a pressure pulse generator via the air tube 32. Here an airflow diffuser mounted centrally in the air tube 32 and rigidly attached to the air tube walls. The diffuser 64 has a large surface area of contact with all air flowing through the air tube 32 and there is no region of air in the diffuser that is far from a diffuser wall. Such a diffuser 64 can be a bundle of straight, thin-wall tubes aligned along the airflow direction occupying the entire cross-section of the air tube. In such case, the dimensions of the thin-wall tubes are preferably in the range of from 10 to 100 microns in diameter and 1 mm to 1 cm in length. Alternatively, the diffuser 64 can be made by sintering together solid spheres, as is well known in the field of chemical engineering. In this case, the diffuser 64 may comprise spheres of a diameter of from 10 to 100 microns and occupying the entire air tube cross-section over a length of from 1 mm to 1 cm. The diffuser is tightly coupled to the air in the air tube by virtue of its geometry, so that when the diffuser 64 is moved by a mechanical oscillator 66, for example, rapidly back and fourth in the direction of airflow, pressure waves 62 in the airstream are induced. Such mechanical motion is easily accomplished by moving the air tube 32 itself periodically along its axis, resulting in a forward pressure wave 62 which travels rapidly to the end of the tube 32. This pressure wave 62 is used in accordance with the present invention to modulate the airstream velocity and thereby the droplet trajectories. For example, an oscillatory motion of the air tube 62 along its length (indicated by the dotted arrow in FIG. 4*b*) at moderate acoustic frequencies, for example frequencies of from 1 to 50 kHz, will result in periodic pressure fluctuations in the tube and hence in periodic changes in the velocity of the airstream 34, 34' and thus in the trajectory of droplets traversing the airstream. Changes in the locations of printed droplets 38, 38' resulting from an oscillating air tube 32 are shown with respect to the gutter position in FIG. 4*i*.

Figure 5A:
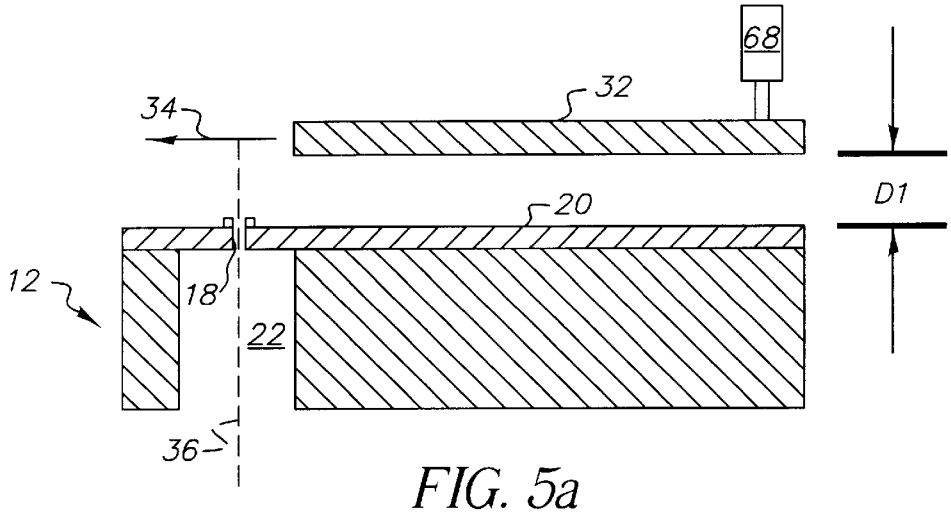
FIG. 5*a* shows a side cross-sectional view of an air tube of an airstream deflector vertically spaced from the membrane in which the printhead nozzles are defined.
Figure 5B:
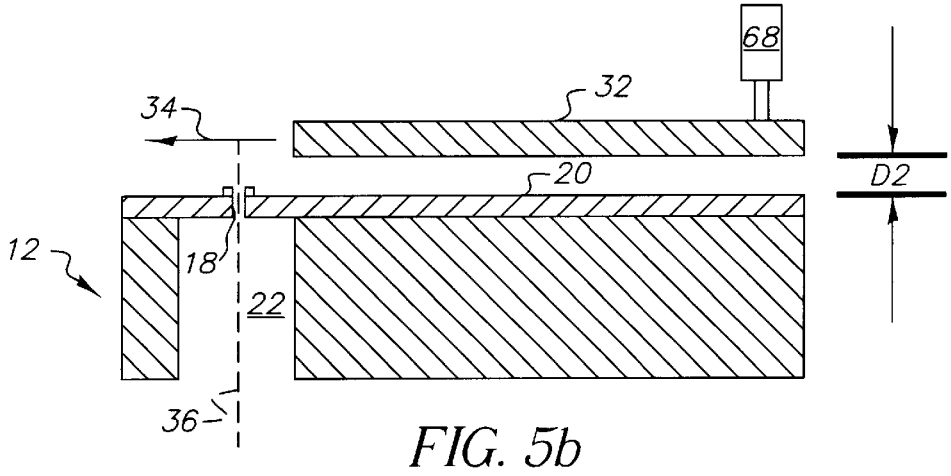
FIG. 5*b* shows a side cross-sectional view of an air tube of an airstream deflector with a reduced vertical spacing from the membrane.
Figure 5C:
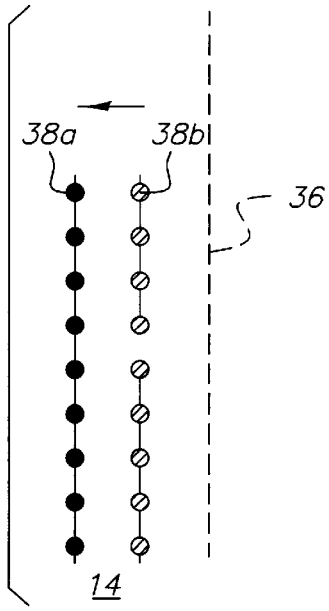
FIG. 5*c* shows a top view of the location of droplets printed on a receiver corresponding to the vertical spacing and the reduced vertical spacing of FIGS. 5*a* and 5*b*, respectively.

FIGS. 5*a*–5*b* show yet another embodiment which achieves the objective of altering the trajectories of droplets ejected from the nozzle 8 from a printhead 12. In this embodiment, the vertical spacing shown in FIG. 5*a* from the bottom of the air tube to the top of the printhead membrane is periodically changed between an increased $D_1$ and a reduced $D_2$ spacing by oscillating the air tube 32 via mechanical oscillator 68. When the spacing is increased to $D_1$, the effect of the airstream 34 on the trajectories of the printed droplets is larger than for the reduced spacing, because the velocities of ejected droplets decrease as the droplets travel further from the printhead 12 and thus the time the droplets spend traversing the airstream 34 increases. As in the previous embodiments, such an oscillatory vertical motion of the air tube 34 at moderate acoustic frequencies, for example frequencies of from 1 to 50 kHz, will result in periodic changes in displacement of printed droplets 38*a*, 38*b* as shown in FIG. 5*c*.

Figure 6:
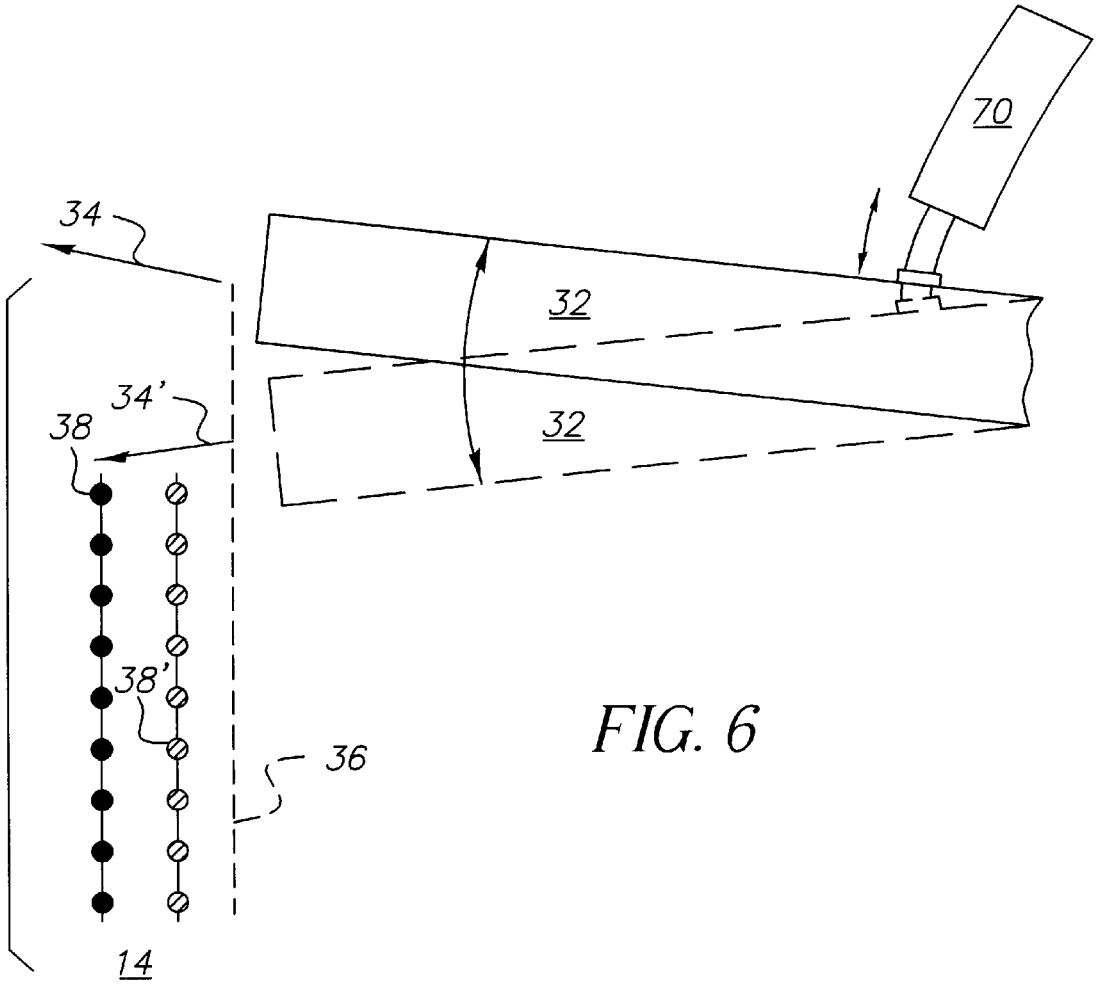
FIG. 6 shows a side cross-sectional view of an air tube of an airstream deflector for two positions of the air tube, a upwardly angled air tube and a lower angled air tube, and a top view of the location of droplets printed on a receiver corresponding to the two angled air tube positions.

FIG. 6 shows a related embodiment which achieves the objective of altering the trajectories of ejected droplets by periodically varying the angle of the air tube 34 from a upper inclination to a lower inclination via a mechanical oscillator 70. When the angle is being increased to the upper inclination, the effect of the airstream 34 on the trajectories of the printed droplets is larger than for the reduced spacing, because the airstream 34 is tracking the ejected droplets, which thus spend more time in the airstream 34. As in the previous embodiments, such an oscillatory angular motion of the air tube 32 at moderate acoustic frequencies, for example frequencies of from 1 to 50 kHz, will result in periodic changes in the displacement of printed droplets 38, 38'.

Figure 7A:
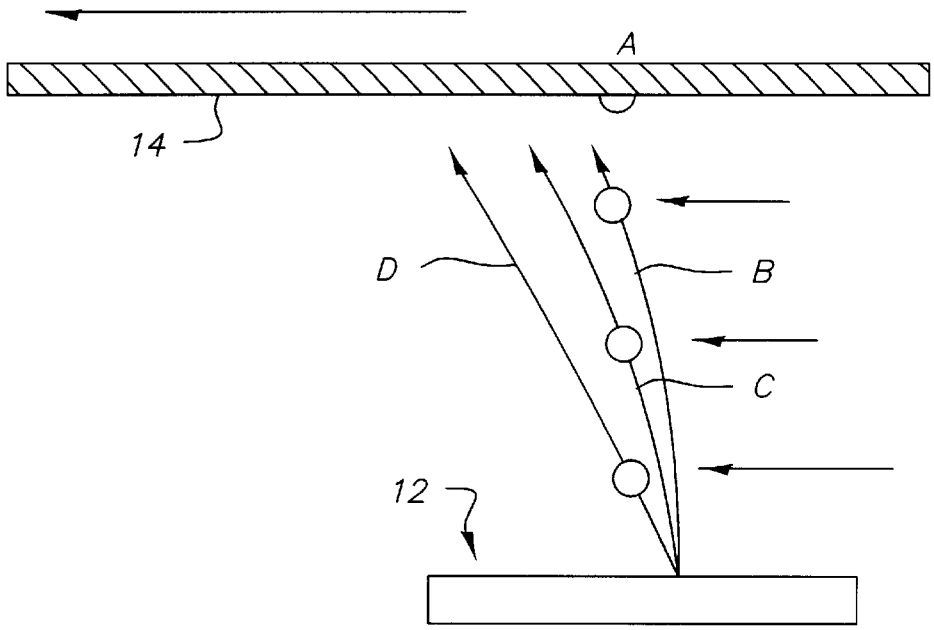
FIGS. 7*a*–7*d* show the trajectories of four ink droplets sequentially ejected from a printhead and landing at a common location on a moving receiver.

FIGS. 7*a*–7*e* show schematically how the present invention adjusts the trajectories of a group of ejected droplets to print them at a common location on a moving receiver 14. In FIG. 7*a*, a first printed droplet A has already landed on the receiver 14, which is moving left. At an earlier time when the first droplet was ejected, the velocity of the airstream was set to a low value and was additionally caused to gradually increase at a rate whose value will be discussed shortly. Thus the average velocity of the airstream experienced by the first droplet during the time it traverses the airstream is somewhere between the value of the airstream velocity when it was ejected and the value of the airstream velocity when it lands on the receiver. In FIG. 7*a*, a second, third, and fourth droplets, following trajectories B, C, and D, are also shown along with arrows representing the average velocity of the airstream experienced by each droplet. Because the airstream velocity is still increasing during ejection of droplets along trajectories B, C, and D, the average velocity horizontal (i.e. velocity in the directions of the airstream) experienced by subsequent droplet increases. Here, average means a time average of the horizontal velocity from the time of droplet ejection to the time the droplet lands on the receiver.

Figure 7B:
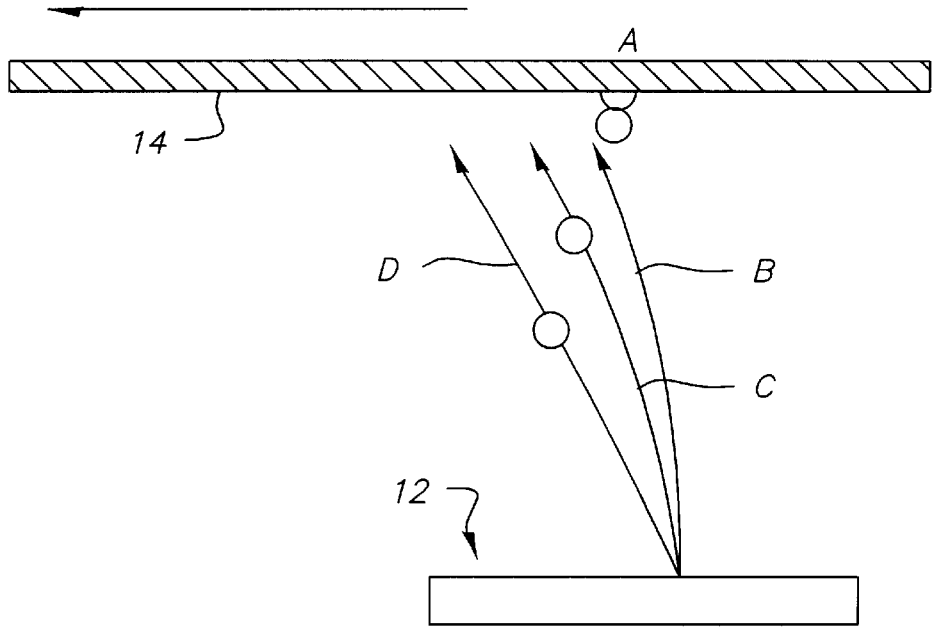

FIG. 7*b* shows schematically the trajectories of the group of droplets at a time slightly later than FIG. 7*a*. Because the average airstream velocity experienced by the second droplet along trajectory B was greater than that experienced by the first droplet, the second droplet lands on the receiver at a position further left with respect to the nozzle than did the first droplet. However, because the receiver 14 has moved a distance also during the time between the landing of the first and second droplets, the second droplet lands directly on the first. This is in fact the criterion for determining the needed rate of increase in airstream velocity.

Figure 7C:
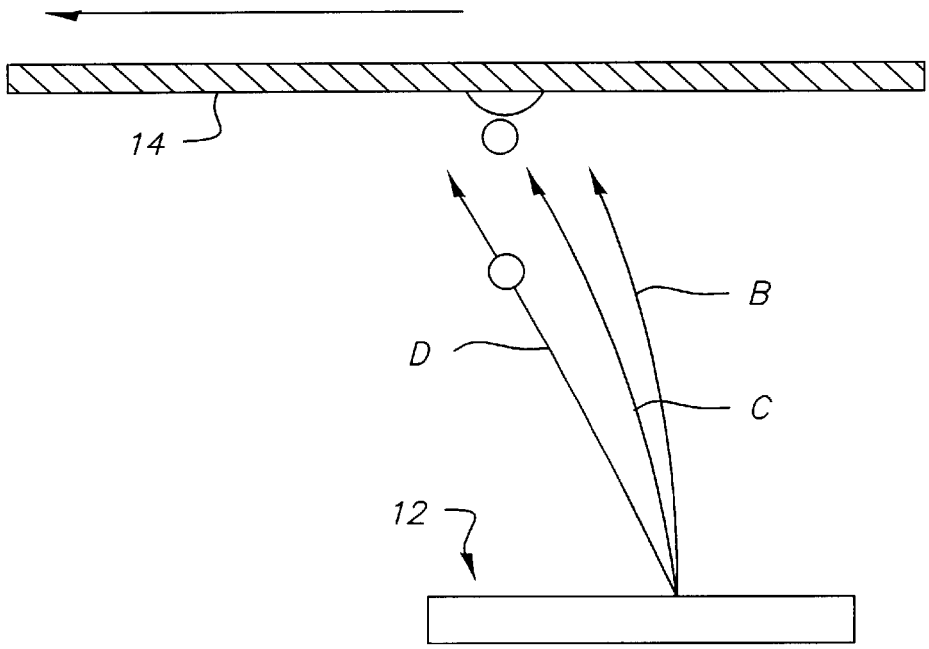

FIG. 7*c* shows schematically the trajectories of the group of droplets at a time slightly later than FIG. 7*b*. Because the average airstream velocity experienced by the third droplet along trajectory C was greater than that experienced by the second droplet, the third droplet lands on the receiver 14 at a position when further left with respect to the nozzle than did the second droplet. Again, because the receiver 14 has moved a distance also during the time between the landing of the second and third droplets, the third droplet lands directly on the first two droplets.

Figure 7D:
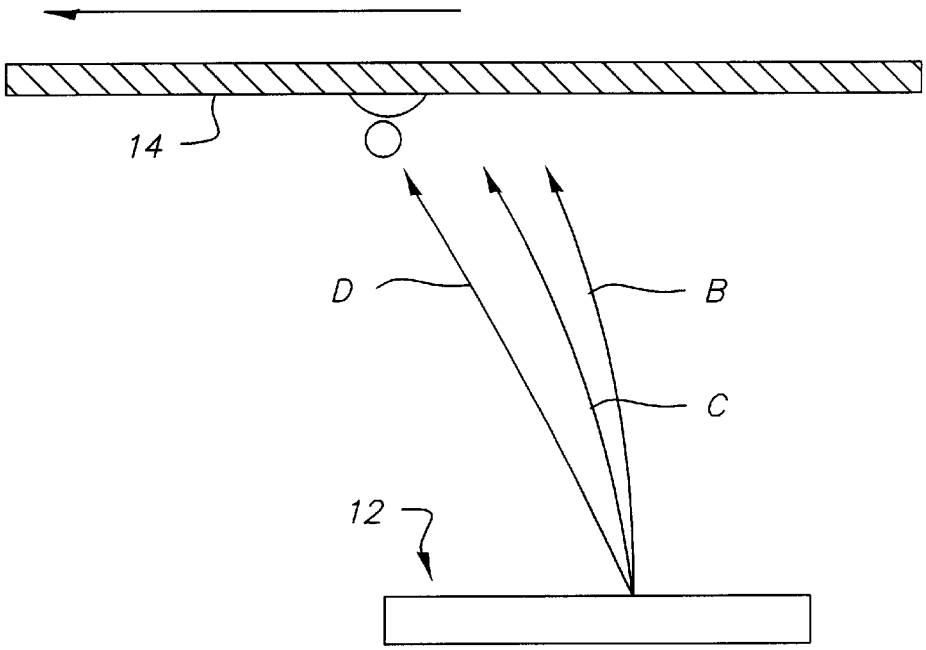

FIG. 7*d* shows schematically the trajectories of the group of droplets at a time slightly later than FIG. 7*c*. Again, because the average airstream velocity experienced by the fourth droplet along trajectory D was greater than that experienced by the third droplet, and because the receiver 14 has moved a distance also during the time between the landing of the third and fourth droplets, the fourth droplet lands directly on the first three droplets. At this time, the airstream velocity is reduced to its lowest value, i.e., the value it had at the time of ejection of the first droplet, and the process is repeated with another group of droplets.

FIGS. 8*a*–8*d* illustrate, in graphical form, variations in the displacement of printed drops in response to four different types of time dependent variations of the velocity of the airstream. The different time dependencies of the airstream velocity, all useful in the practice of the current invention, are shown in FIGS. 8*a*–8*d*. In these cases, the airstream velocity is varied periodically in time with a period which is chosen, for simplicity of illustration, to be approximately equal to the time required for an ejected drop to traverse the airstream. In each case, only a single period of the variation in airstream velocity is graphed, the repetitions being thereafter identical. The airstream velocities are indicated by heavy dashes in FIGS. 8*a*–8*d* and the printed drop displacements are indicated by light dashes. In all cases, the airstream velocity (vertical axis) is plotted as a function of time (horizontal axis). The left end of time axis in each figure is defined as time t=0 and the right end corresponds to one period of the variation in airstream velocity.

In each case, only variations of the airstream velocity are show, although generally, in accordance with the present invention, these variations may be superposed on a constant airstream velocity, chosen so that printed drops are deflected sufficiently to miss the gutter. Typically, the magnitude of the time dependent portion of the airstream velocity is a fraction of the magnitude of the constant portion of the airstream velocity, for example one tenth to nine tenths the constant portion. However, this range should not be construed as limiting. In fact, because the time dependent portion of the airstream velocity itself can sufficiently deflect the printed drops so as to miss the gutter, the present invention can be practiced even in the absence of a time independent portion of the airstream velocity.

The time dependent portion of the airstream velocity results in a variation of drop displacement relative to any fixed reference position on the printhead itself, for example the position of the edge of the gutter. The amount of drop displacement in each of the cases of FIGS. 8*a*–8*d* varies depending on the time of drop ejection relative to t=0. Thus the printed drop displacement, relative to the edge of the gutter, is plotted on the vertical axis as a function of the delay time between the ejection of the drop and the start (t=0) of the periodic variation of the airstream velocity. In this sense, the time axis has a different interpretation for the airstream velocity versus the printed drop displacement. For the printed drop displacement, the left end of the time axis corresponds to the case that the drop is ejected into the airstream at t=0, at which time, in these illustrative examples the velocity of the airstream is beginning to increase, whereas the middle of the time axis corresponds to the case that the drop is ejected into the airstream at a time halfway through the periodic variation of the airstream velocity, etc.

In all cases the velocities and displacements are scaled to the value of their maximum excursions, for example the peak height of the plotted velocities in each of FIGS. 8*a*–8*d* represents 100% of its maximum time variation. These curves have been modeled assuming that the force in the direction of the airstream on drops traversing the airstream is at any moment proportional to the airstream velocity at the location of the drop and that the drop velocities in the direction of the airstream are small compared to the drop velocities perpendicular to the airstream.

Figure 8A:
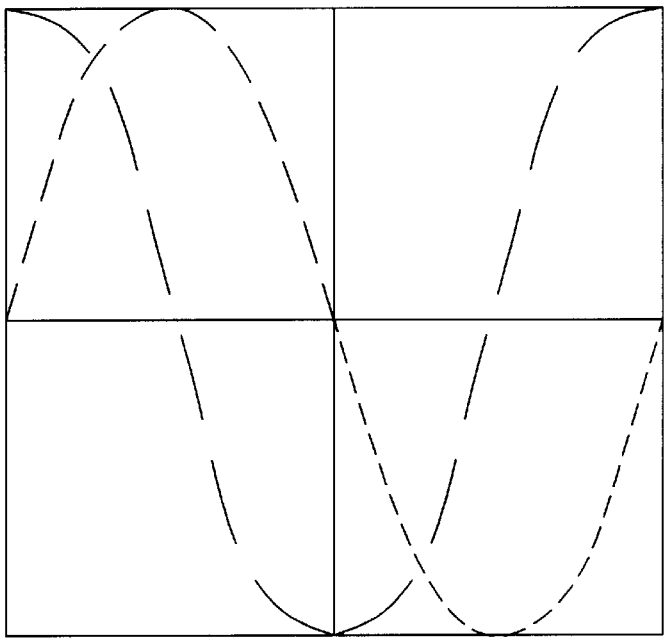
FIGS. 8*a*–8*d* show schematically four examples of the printed drop displacement (vertical axis) as a function of time (horizontal axis) for corresponding plots of airstream velocity (vertical axis) as a function of time (horizontal axis) for an airstream deflector. In each case, the periodic dependence of airflow on time is of the same duration as the time required for an ejected droplet to traverse the airstream.

In FIG. 8*a*, the airstream velocity is modulated in time in a sinusoidal manner, about an average value represented by the central horizontal line in the graph. In this case, the resulting dependence of the printed drop displacement (light dashed line) on the delay time between the ejection of the drop and the start (t=0) of the periodic variation of the airstream velocity is also a sinusoidal function having a delayed phase, that is, a cosine function. In this case, the drops are maximally displaced when launched at the time the time dependent portion of the airstream velocity is rising at its maximum rate.

Figure 8B:
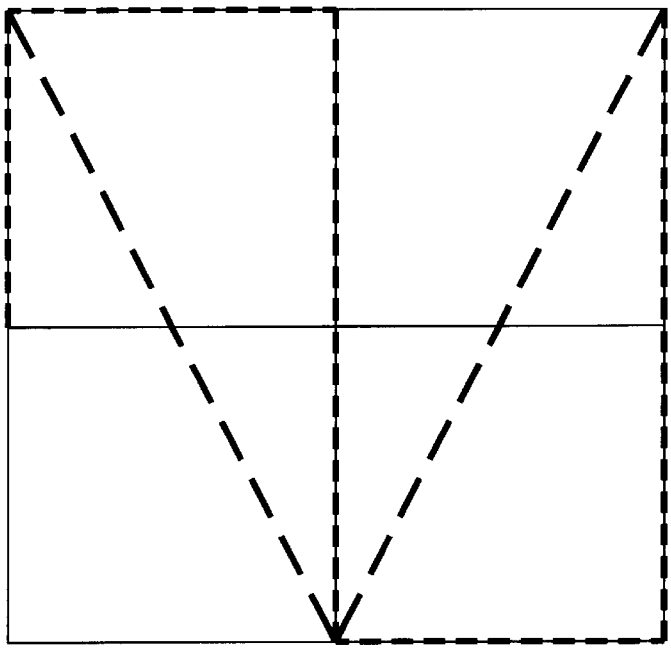

In FIG. 8*b*, the airstream velocity is modulated in time in square wave manner, about an average value represented by the central horizontal line in the graph. In this case, the resulting dependence of the printed drop displacement on the delay time between the ejection of the drop and the start (t=0) of the periodic variation of the airstream velocity is a triangular function, as shown by the light dashed line.

Figure 8C:
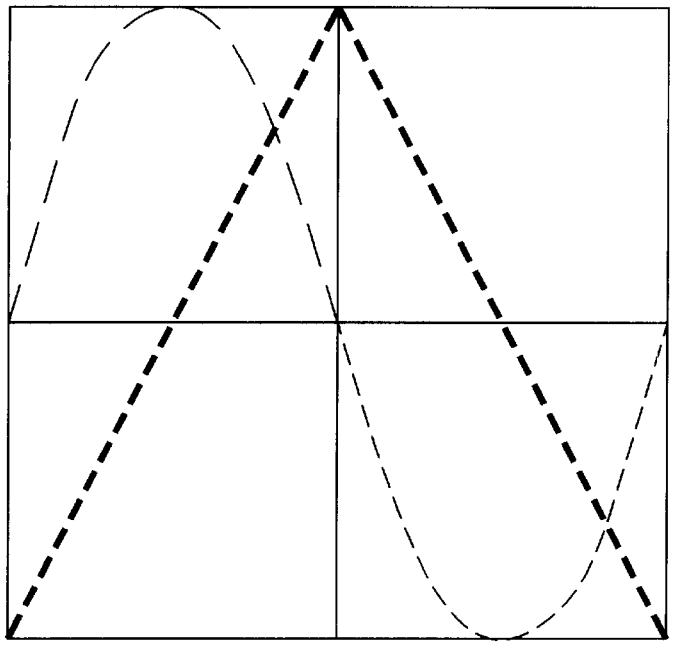

In FIG. 8*c*, the airstream velocity is shown modulated in time in a triangular manner, about an average value represented by the central horizontal line in the graph. In this case, the resulting dependence of the printed drop displacement or the delay time between the ejection of the drop and the start (t=0) of the periodic variation of the airstream velocity is maximal when the ejected drop is launched midway during the rise of the airstream velocity.

Figure 8D:
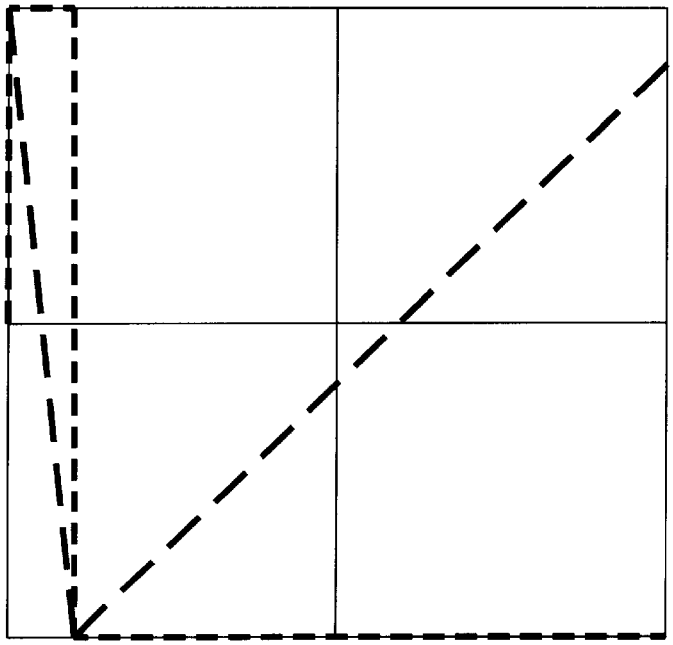

In FIG. 8*d*, the airstream velocity is modulated in time in an asymmetric manner. The central horizontal line in the graph is the mid point of the modulation extrema. In this case, the resulting dependence of the printed drop displacement is a distorted triangular function, again as shown by the light dashed line.

While all waveforms are in principal useful in controlling the landing locations of drops passing through the airstream, in practice modulation of the airstream velocity in a asymmetric manner is preferred in order to provide a sustained and linear increase in the displacements of subsequently ejected drops, which ensures the possibility of all drops landing in a common location on a uniformly moving receiver. The maximum amplitude of the modulation of the airstream velocity is chosen so that the change in displacement of subsequent drops matches the distance moved by the receiver over the time interval between subsequently ejected drops. Many other functional forms of the time dependent velocity component of the airstream velocity may be usefully employed, including cases in which groups of drops desired to be printed in identical positions are ejected over a time which is only a fraction of the repetition time of the airstream velocity variations, in order that more than one such group of drops can be ejected during the repetition time.

The invention has been described in detail with particular reference to certain preferred embodiments thereof, but it will be understood that variations and modifications can be effected within the spirit and scope of the invention. In particular, while the droplet deflector is preferably of the airstream type, any type of droplet deflector is within the scope of the invention, which is limited only by the claims appended hereto and equivalents thereto.

PARTS LIST

1 Printhead
3. Row of nozzles
5. Receiver
7. Fast scan direction
9. Slow scan direction
10. Inkjet printer
12. Printhead
14. Receiver
15. Droplet deflector
16. Ink droplets
18. Nozzle
20. Membrane
22. Ink cavity
26. Large size droplets
28. Small size droplets
30. Heating element
32. Air tube
33. Outlet
34. Airflow
36. Gutter
38. Printed droplets
40. Restrictor
42. Membrane
44. Restrictor
46. Membrane
48. Tapered end portion
50. Moveable cantilevers
52. Movable vanes
54. Fixed vanes
56. Pressures pulse generator
58. Piezo transducer
59. Diaphragm
60. Armature
62. Compressive wave
64. Diffuser
66. Mechanical oscillator
68. Mechanical oscillator
70. Mechanical oscillator

What is claimed is:

1. An inkjet printer for printing ink droplets onto a receiver, comprising:

a printhead having at least one nozzle for ejecting a stream of ink droplets, said printhead adapted to eject a stream of ink droplets of different sizes;

a droplet deflector adapted to generate a continuous flow of gas that impinges on said stream of ejected droplets to deflect a trajectory of said droplets, said droplet deflector adapted to deflect said droplets of different sizes different distances;

a controller for varying the velocity of said gas flow to vary a degree of trajectory deflection for said droplets; and an ink gutter adapted to catch deflected ink droplets of one of said different sizes before said droplets print onto a receiver.

2. The inkjet printer defined in claim 1, wherein said droplet deflector includes a tube for directing said gas flow onto impingement with said droplets and said controller includes a gas flow restrictor for varying said gas flow velocity by variably restricting said gas flow through said tube.

3. The inkjet printer defined in claim 2, wherein said air flow restrictor includes an expandable bladder disposed within said tube.

4. The inkjet printer defined in claim 3, wherein said bladder is disposed within said tube near an outlet end thereof.

5. The inkjet printer defined in claim 3, wherein said bladder is disposed within said tube near a central portion thereof.

6. The inkjet printer defined in claim 2, wherein said gas flow restrictor includes at least one movable cantilever disposed within said tube.

7. The inkjet printer defined in claim 6, wherein said cantilever is electrostatically moved from positions causing greater and lesser resistance to gas flow in said tube.

8. The inkjet printer defined in claim 6, wherein said cantilever is bimetallically moved from positions causing greater and lesser resistance to gas flow in said tube.

9. The inkjet printer defined in claim 2, wherein said gas flow restrictor includes at least one movable vane disposed within said tube.

10. The inkjet printer defined in claim 1, wherein said droplet deflector includes a tube for directing said gas flow into impingement with said droplets, and said controller includes a pressure pulse generator for varying said gas flow velocity by generating variable pressure pulses in said tube.

11. The inkjet printer defined in claim 10, wherein said pressure pulse generator includes a diaphragm connected to an armature for rapidly moving said diaphragm.

12. The inkjet printer defined in claim 11, wherein said armature is moved by a piezoelectric transducer.

13. The inkjet printer defined in claim 10, wherein said pressure pulse generator includes a diffuser disposed within said tube, and a vibrational mechanism for variably vibrating the tube and diffuser toward and away from said droplet stream.

14. The inkjet printer defined in claim 1, wherein said droplet deflector includes a tube for directing said gas flow into impingement with said droplets, and said controller includes an oscillating mechanism for variably oscillating an outlet of said tube with respect to said droplet stream.

15. The inkjet printer defined in claim 14, wherein said oscillating mechanism oscillates said tube in a direction substantially perpendicular to a longitudinal axis of said tube.

16. The inkjet printer defined in claim 14, wherein said oscillating mechanism oscillates said tube around a point on a longitudinal axis of said tube.

17. The inkjet printer defined in claim 1, wherein the controller varies a degree of trajectory deflection for said droplets such that droplets intended for printing on a selected pixel of a receiver are deposited substantially on top of one another.

18. The inkjet printer defined in claim 1, wherein said gas flow is a flow of air.

19. The inkjet printer defined in claim 1, wherein said printhead includes an ink cavity containing ink under pressure sufficient to eject said stream of ink droplets.

20. An inkjet printer for printing ink droplets onto a receiver, comprising:

a printhead having at least one nozzle for ejecting a stream of ink droplets;

a droplet deflector for generating a flow of gas that impinges on said stream of ejected droplets to deflect a trajectory of said droplets, said droplet deflector including a tube for directing said gas flow onto impingement with said droplets; and a controller for varying the velocity of said gas flow to vary a degree of trajectory deflection for said droplets, said controller including a gas flow restrictor for varying said gas flow velocity by variably restricting said gas flow through said tube, wherein said gas flow restrictor includes at least one movable cantilever disposed within said tube.

21. The inkjet printer defined in claim 20, wherein said cantilever is electrostatically moved from positions causing greater and lesser resistance to gas flow in said tube.

22. The inkjet printer defined in claim 20, wherein said cantilever is bimetallically moved from positions causing greater and lesser resistance to gas flow in said tube.

23. An inkjet printer for printing ink droplets onto a receiver, comprising:

a printhead having at least one nozzle for ejecting a stream of ink droplets;

a droplet deflector for generating a flow of gas that impinges on said stream of ejected droplets to deflect a trajectory of said droplets, said droplet deflector including a tube for directing said gas flow onto impingement with said droplets; and a controller for varying the velocity of said gas flow to vary a degree of trajectory deflection for said droplets, said controller including a gas flow restrictor for varying said gas flow velocity by variably restricting said gas through said tube, wherein said gas flow restrictor includes at least one movable vane disposed within said tube.

24. An inkjet printer for printing ink droplets onto a receiver, comprising:

a printhead having at least one nozzle for ejecting a stream of ink droplets;

a droplet deflector for generating a flow of gas that impinges on said stream of ejected droplets to deflect a trajectory of said droplets, and a controller for varying the velocity of said gas flow to vary a degree of trajectory deflection for said droplets, wherein said droplet deflector includes a tube for directing said gas flow into impingement with said droplets, and said controller includes a pressure pulse generator for varying said gas flow velocity by generating variable pressure pulses in said tube.

25. The inkjet printer defined in claim 24, wherein said pressure pulse generator includes a diaphragm connected to an armature for rapidly moving said diaphragm.

26. The inkjet printer defined in claim 25, wherein said armature is moved by a piezoelectric transducer.

27. The inkjet printer defined in claim 24, wherein said pressure pulse generator includes a diffuser disposed within said tube, and a vibrational mechanism for variably vibrating the tube and diffuser toward and away from said droplet stream.

28. An inkjet printer for printing ink droplets onto a receiver, comprising:

a printhead having at least one nozzle for ejecting a stream of ink droplets;

a droplet deflector for generating a flow of gas that impinges on said stream of ejected droplets to deflect a trajectory of said droplets, and a controller for varying the velocity of said gas flow to vary a degree of trajectory deflection for said droplets, wherein said droplet deflector includes a tube for directing said gas flow into impingement with said droplets, and said controller includes an oscillating mechanism for variably oscillating an outlet of said tube with respect to said droplet stream.

29. The inkjet printer defined in claim 28, wherein said oscillating mechanism oscillates said tube in a direction substantially perpendicular to a longitudinal axis of said tube.

30. The inkjet printer defined in claim 28, wherein said oscillating mechanism oscillates said tube around a point on a longitudinal axis of said tube.

31. A method of printing comprising steps of:

forming a stream of printing and non-printing ink drops, the printing ink drops and the non-printing ink drops each having a size, the size of the printing ink drops being different than the size of the non-printing ink drops;

deflecting the stream of printing ink drops and the non-printing ink drops using a continuous flow of gas having a velocity such that the non-printing drops begin travelling along a non-printing path and printing drops begin travelling along a printing path;

varying the velocity of the continuous flow of gas such that an amount of deflection of the stream of printing and non-printing ink drops is controlled;

collecting the non-printing ink drops travelling along the non-printing path in an ink gutter; and allowing the printing ink drops to continue travelling along the printing path and impinge on a receiver, wherein varying the velocity of the continuous flow of gas allows each printing ink drop to impinge the receiver at a desired location of the receiver.

32. The method as defined in claim 31, wherein varying the continuous flow of gas includes restricting the flow of gas being provided by a droplet deflector using at least one movable cantilever disposed within the droplet deflector.

33. The method as defined in claim 31, wherein varying the continuous flow of gas includes restricting the flow of gas being provided by a droplet deflector using at least one movable vane disposed within the droplet deflector.

34. The method as defined in claim 31, wherein varying the continuous flow of gas includes varying the flow of gas being provided by a droplet deflector by generating variable pressure pulses in the droplet deflector using a controller including a pressure pulse generator.

35. The method as defined in claim 31, wherein varying the continuous flow of gas includes varying the flow of gas being provided by a droplet deflector using a controller including an oscillating mechanism for variably oscillating an outlet of the droplet deflector with respect to the stream of printing and non-printing ink drops.

* * * * *